US008161186B2

(12) United States Patent
De Lajudie et al.

(10) Patent No.: US 8,161,186 B2
(45) Date of Patent: Apr. 17, 2012

(54) COMMUNICATION SYSTEM BETWEEN A VEHICLE NETWORK AND A WAYSIDE NETWORK

(75) Inventors: Raphaelle De Lajudie, Paris (FR); Nicolas Renard, Paris (FR); Wissam Loudhaief, Rueil-Malmaison (FR); Mathieu Rivoalen, Morlaix (FR)

(73) Assignee: Siemens SAS, St. Denis (FR)

( * ) Notice: Subject to any disclaimer, the term of this patent is extended or adjusted under 35 U.S.C. 154(b) by 667 days.

(21) Appl. No.: 11/919,772

(22) PCT Filed: May 3, 2006

(86) PCT No.: PCT/EP2006/004110

§ 371 (c)(1),
(2), (4) Date: Nov. 1, 2007

(87) PCT Pub. No.: WO2006/125510

PCT Pub. Date: Nov. 30, 2006

(65) Prior Publication Data

US 2009/0063700 A1 Mar. 5, 2009

(30) Foreign Application Priority Data

May 23, 2005 (EP) ..... 05291105

(51) Int. Cl.
*G06F 15/173* (2006.01)
*G06F 15/16* (2006.01)
*H04B 1/26* (2006.01)

(52) U.S. Cl. ..... 709/238; 709/249; 455/432.1

(58) Field of Classification Search ..... 709/238, 709/249; 455/432.1
See application file for complete search history.

(56) References Cited

U.S. PATENT DOCUMENTS

| | | | | |
|---|---|---|---|---|
| 6,032,905 | A * | 3/2000 | Haynie | 246/3 |
| 2002/0098840 | A1 * | 7/2002 | Hanson et al. | 455/435 |
| 2003/0028625 | A1 | 2/2003 | Sanjeev et al. | |
| 2003/0153338 | A1 * | 8/2003 | Herz et al. | 455/517 |
| 2003/0210671 | A1 * | 11/2003 | Eglin | 370/338 |
| 2004/0023652 | A1 * | 2/2004 | Shah et al. | 455/426.2 |
| 2004/0093426 | A1 | 5/2004 | Sahasrabudhe et al. | |
| 2005/0070326 | A1 * | 3/2005 | Morton | 455/552.1 |

FOREIGN PATENT DOCUMENTS

EP 0 958 987 A2 11/1999

(Continued)

OTHER PUBLICATIONS

Derwent Abstract—EP 0 958 987 A2; Nov. 24, 1999; Alcatel, F-75008 Paris, France.

(Continued)

*Primary Examiner* — Ranodhi Serrao
(74) *Attorney, Agent, or Firm* — Laurence A. Greenberg; Werner H. Stemer; Ralph E. Locher

(57) ABSTRACT

A system for communications between a vehicle network and a wayside network includes a router in the vehicle network configured to manage routing of data over one of at least two clients, and a radio-frequency based communication network for providing a connection between each client and an access point linked to the wayside network. A monitoring device in a vehicle of the vehicle network is configured to control a quality of the connection in order to configure the router so that one of the clients is selected for the data routing between the vehicle and the wayside network.

12 Claims, 3 Drawing Sheets

FOREIGN PATENT DOCUMENTS

| | | | |
|---|---|---|---|
| EP | 1 071 239 | A1 | 1/2001 |
| JP | 2002271247 | A | 9/2002 |
| JP | 2004096356 | A | 3/2004 |
| WO | WO 01/26337 | A2 | 4/2001 |

OTHER PUBLICATIONS

Derwent Abstract—EP 1 071 239 A1; Jan. 29, 2001; Alstom, F-75116 Paris, France.

* cited by examiner

COMMUNICATION SYSTEM BETWEEN A VEHICLE NETWORK AND A WAYSIDE NETWORK

CROSS-REFERENCE TO RELATED APPLICATIONS

The present application is a national stage application of International Application No. PCT/EP2006/004110, filed on May 3, 2006, which claims priority to European Application No. 05291105.4, filed on May 23, 2005, both of which are incorporated herein by reference.

BACKGROUND OF THE INVENTION

The present invention relates to a communication system between a vehicle network and a wayside network.

According to the terminology "vehicle" the invention concerns especially rail train with one or more units in which a communication means between a trainborne network and a wayside network is provided.

A first communication system is disclosed in WO200126337-A2 wherein a remote controlling of electronic components in vehicles through Internet as wayside network is provided for example for transmitting routing and security information for multimedia traffic through a device (GPS device, cellular phone, PDA, etc) connected over Wireless Local Area Network WLAN. By this way, a radio-frequency (wireless) connection from Internet to a so-called client (remote device) in the vehicle can be provided.

According to EP1071239-A1 a train network with radio frequency based network between a transmitter (=client in the train) and a receiver (=access point at the wayside) is disclosed. To secure the active transfer of information between these two stations across the network a frame is transmitted from transmitter to receiver. By non valid or absent received frame at the receiver a non-valid confirmation is sent back to the transmitter to re-iterate the initial transfer of information. By this way a loss of signal information from a broken communication path can be avoided.

Furthermore, due to the limited transmission distance as the vehicle moves, a connection based on radio-frequency transmission/reception between a client in the vehicle and one of access points of the wayside network has to be actualized in a way that avoids a loss of connection. Such a new association procedure between a client and a new access point is known as a so-called roaming function. Unfortunately, the association and the roaming processes require a time period during which a communication of a data stream is not possible.

SUMMARY OF THE INVENTION

It is therefore the aim of this invention to provide a system to avoid a loss of communication between a vehicle and a wayside network that are connected by radio-frequency means.

This aim is achieved by the present invention which discloses a communication system that takes frequently in account the quality of radio-frequency connection between a plurality of distinct clients in the vehicle and respective access points at the wayside in order to provide a stable connection with permanent high quality. According to the invention, the transmission/reception of a data stream over a first low quality's client based gateway between the vehicle and the wayside network can be re-directed in real-time over a second higher quality's client based gateway. By this solution, the usual slow functionality of roaming between a single client in a train and access points at the wayside can be avoided.

The presented communication system between a vehicle network and a wayside network is characterized in that

- said vehicle network comprises a router managing a data routing over one of at least two clients,
- a connection is provided over a radio-frequency based communication network between each client and an access point linked to said wayside network,
- said vehicle comprises monitoring means that frequently control the radio-frequency's quality of each client in order to configure the router so that one of the client is selected for said data routing between the vehicle and wayside networks.

Both clients are disposed at opposite ends of the vehicle and directed at opposite ways. Especially, the invention provides an appropriate solution for a long vehicle like a bus, a train unit or a whole train with coupled units. In the following specification, the invention will be focused on a rail train with at least one train unit.

The router of the train should be interpreted as a router of one or more train units. It manages data routing over one client among all train units.

Principally a train with one or more units should comprise at least a router and two clients. However, each train unit could comprise also this "one router and two clients" based configuration which is flexible and always well adapted for one or identical coupled train units. By this way, each train unit can be connected to the wayside network through one of its clients, but also through a client of a further train unit if the train units are so coupled that a permanent train network is provided. For a non-restrictive purpose of clarity, the "one router and two clients" based configuration for a train unit has been chosen for the further description of invention.

A further advantage of the invention consists in a clustered configuration of access points that are distributed in areas along the train rails. The radio frequency based connection of both clients is performed over distinctive access points that belong to the same or different clusters that are connected to the wayside network. A switch between two access points of a same cluster is hence permanently ensured. As well, a switch between two access points of two different clusters can be provided in real-time by means of a cluster router. A data re-routing by selecting a new client based gateway between the train and the wayside network doesn't depend anymore on roaming periods between clients and access points like in the described state-of-the-art, because switching processes are provided independently from usual slow clients roaming functions. All clients in the train are simultaneously connected to access points but only one is active for the data transmission. The switch period between them can also be considerably reduced by providing a switch at the wayside instead of the client side.

According to the wayside configuration, the access points are spatially arranged in a such way that a radio-frequency communication between two clients and the wayside network is permanently enabled over a single or two different clusters. By this way, a cluster dependent switch is also permanently enabled. If it is not the case, a means for storing temporary for example a train-outgoing data stream can be provided in the train network at least during the non-enabled communication.

The clusters are connected to a main wayside router of the wayside network over a cluster router and a data re-routing from a client in a train unit linked to a first cluster to a new selected client in the same or another train unit linked to a second cluster is provided by switching the cluster routers. In any way, the cluster routers are switched such that an in- or outgoing data streams are not interrupted.

Generally the wayside network backbone is divided into several wayside subnets that can be linked to different clusters.

Advantageously, a data re-routing between a new selected client in the train and the main wayside router over different wayside clusters which are linked to different wayside subnets is performed by the main wayside router such that data are switched in real-time to the corresponding selected access point over the cluster router comprising the selected access point. This is possible because before or when a new client is physically selected, the train router forwards, in addition to the data traffic management from the train, the new routing scheme—new client, new access point/cluster—to the main wayside router. Hence, the main wayside router can permanently adapt the data routing over the subnets and the according clusters thanks to this updated association table.

At any time, the main wayside router comprises a routing address of the vehicle over the access point that is associated to selected client of train over the corresponding cluster router. This address is transmitted from the train router to the main wayside router in the frequently sent routing scheme. Therefore, the train router and the main wayside router are permanently informed on the routing scheme that should be used at any moment the train is moving. Once again, the routing scheme is transparent for the clients in the train, because after monitoring the best radio-frequency signal, only both train and main wayside routers manage the in- and outgoing data routing by permanently exchanging a preferred routing scheme according to a high quality radio-frequency criterion. The clients are only used as data gateway between train and main wayside routers, but their possible roaming means have not to be used.

As a result, the cluster routers, the access points and their corresponding clients belong to a single radio frequency based network like a WLAN (Wireless Local Area Network) even if the wayside network is composed of several subnets. The switching over a new client is however provided there at the train and the cluster routers.

The train router can manage the data routing by means of a vehicle or, by coupled train units, a train specific and periodically actualized simple data table with a first client identifier, a corresponding radio-frequency's quality and a second access point identifier linked to the wayside network over an attached cluster router. By change of the data table content said new content is transmitted to main wayside router over the selected client, then its associated access point and the attached cluster router. Then the content of the table is stored at the main wayside router until a new content is provided from train router. By coupled train units, the data table can also contain a further train unit identifier. Hence, the routing of the invention is based on a very simple and reliable procedure.

If the clients support a broadband data transfer, the invention makes it possible to exchange continuously data with a high speed. By this way, if at least one of the clients in the train comprises a acquisition and/or rendering device for real-time data, some very useful applications can be used in order to get data from the train and/or to send data from the wayside to a train or to a train unit. For example, a video or sound monitoring application in the train can be provided by using cameras or microphones so that wayside operators can request train data stream over a wayside server. By this way, the safety and security in the train can be reliably enhanced.

On a second hand, a permanent transmission of data or instructions from the main wayside router is always possible over which some applications in the train can be initiated. An application can be provided in order to inform passenger of the train over a client linked to a video display or a speaker. Further applications could be useful for the rail train management over a client linked to control devices of the train, especially if the train is entirely driven from wayside operators.

BRIEF DESCRIPTION OF THE SEVERAL VIEWS OF THE DRAWINGS

Examples of the invention are described below with reference to the drawings. In the drawings.

DETAILED DESCRIPTION OF THE INVENTION

Figure 1:
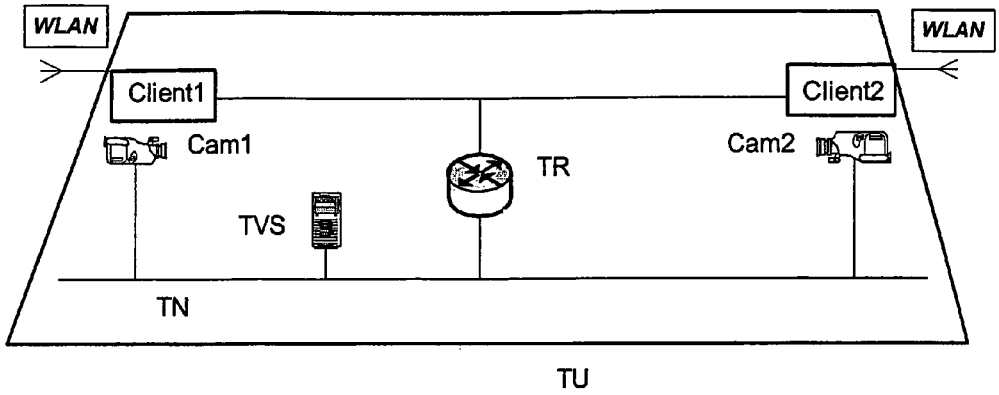
FIG. 1 is a schematic view of vehicle network architecture.

FIG. 1 is a schematic view of vehicle network architecture, for example for a train unit TU with a train network TN comprising a train router TR managing a data routing over one of at least two clients Client1, Client2 according to the invention. The monitoring means for measuring radio-frequency of the signal's quality from the clients can be integrated in the train router. The communication between the train network TN and a wayside network is provided by using one of the both clients Client1, Client2 as a gateway. In this example the communication is based on a WLAN radio-frequency connection (see the antenna of clients). For video monitoring application, two cameras Cam1, Cam2 are linked to the clients Client1, Client2 over the train network TN. Both cameras Cam1, Cam2 are generating video data streams that are re-directed over the selected client via the WLAN network to an access point at the wayside. A train video server TVS (or train unit video server) is also connected to the train network TN in order to address/identify the requests of connection for a video data routing between the train and the wayside network.

In order to optimize the radio coverage, one WLAN client of the diverse clients Client1, Client2 is used at each train or train unit end. Only one client is transmitting at a given moment. This WLAN client is qualified as active. The other WLAN clients exchange management frames with access points along the track, in the frame of a "Association Process", but are not used for actual communication with the wayside network.

The train router TR manages the choice of the selected client via a signal quality under the diversity of train clients. Then the selection of this active client will be forwarded to the wayside network over updated wayside network routes accordingly.

The Active WLAN client is the one who has the higher RF (radio-frequency) signal quality. This signal quality is quantified by the RSSI (Radio Signal Strength Indication) obtained through SNMP (Simple Network Management Protocol) periodic requests (for instance every 300 ms). A RSSI-based routing algorithm handles as follows:

The train router TR sends SNMP periodic requests to both WLAN Clients Client1, Client2.

It chooses as active WLAN client the one that has the best RSSI.

In order to deal with RF fading and avoid unnecessary route changes, it is possible to take into account several successive RSSI reports and to apply an hysteresis before making a decision.

This client diversity in a train provides also several benefits:

The transmission loss of one client during its roaming from one Access point to another has no impact on the Network performance since another active client is typically used at this time.

The radio coverage is significantly improved so the distance between the access points on the line can be increased.

Due to clearance issues in Mass Transit tunnels, it is typically impossible to place an antenna above the train top, reducing the radio coverage. The client diversity is a good design solution to this issue.

It is also possible to distribute at least the two clients over a train with more than two units at each end of the whole train. Typically it is also easier to manufacture identical train units, each of them comprising means to install several clients.

One train router TR can be used for a whole train. It is also possible to use one or more of many train unit routers separately if necessary, because the train units and their subnetworks are typically coupled electrically, mechanically and/or radio-frequently in order to form a single train network. This aspect is however seamless for the main scope of the invention. Anyway it is possible for an operator at the wayside to provide a permanent connection with a train unit via a router and a client among the whole train.

This application allows monitoring the trains using a digital streaming of video pictures by using one or more cameras Cam1, Cam2 inside trains to a central safety and security monitoring premise (usually the Operational Control Center—OCC).

This multimedia application is based on:

A wayside server which acts as a concentrator and relay for OCC operator at the wayside requests and media streams. It relays the requests coming from the operators to the train, receives the requested camera media stream from the train network system and then routes them to the appropriate operator.

The train video server TVS that receives the requests for media streams coming from the wayside, handles the camera media streams and sends in return the requested streams to the wayside server.

Figure 2:
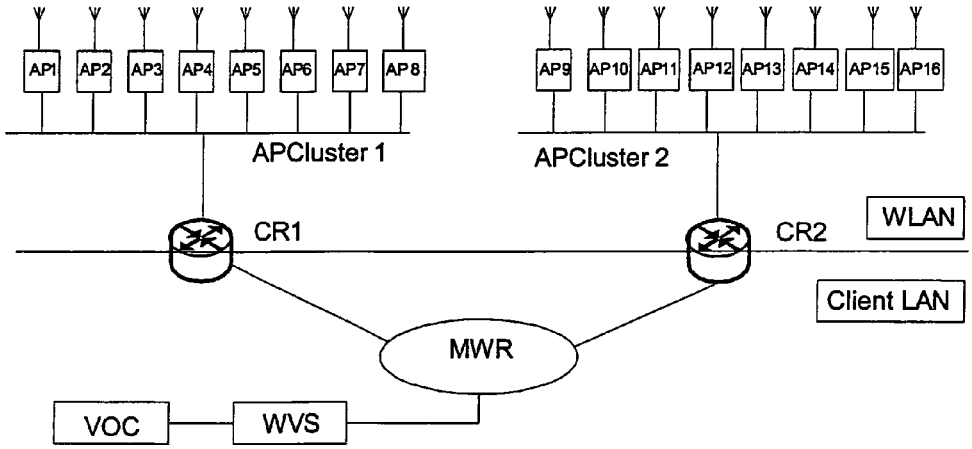
FIG. 2 presents the structure of the wayside network.

FIG. 2 presents the structure of the wayside network with access points AP1, . . . , AP16 that make possible the WLAN communication with the clients Client1, Client2 of FIG. 1. Like the clients, the access points comprise antenna over which radio-frequency data are transmitted to the train or received from the train. One access point is linked to one or both clients in a train. According to the invention, FIG. 2 shows two clusters APCluster1, APCluster2 that respectively comprises a group of railway-distributed access points AP1, . . . , AP8 and AP9, . . . , AP16. Each one of the clusters APCluster1, APCluster2 and also its corresponding access points is linked to the wayside LAN (Local Area Network) (Client LAN) via a cluster router CR1, CR2 that provides a switch between said clusters and a central main wayside router MWR. In case of a video monitoring of train units, the main wayside router MWR can be connected to a video operator console VOC over a wayside video server WVS.

As said, the WLAN is composed of the wayside access points and their trainborne clients. They all belong to the same subnet so that the roaming is seamless for the client. So, the roaming from one client to another one (and also from associated access point to another one) is performed at Ethernet Level 2 Layer.

The architecture that is described may use any WLAN based on Ethernet protocols. Presently, transmission standards 802.11a and 802.11g are very common, OFDM modulation ensures robustness and provides a high throughput. There are also many WLAN standard variants providing specific features that may be used as well and the described architecture may be applied to any WLAN standard based on IP protocols. The choice of the radio frequency RF band depends on the site and regulatory environment.

The wayside access points are physically linked through CPL or VDSL (Very High Data Rate) technology. According to the limited range of these both technologies, they also have to be geographically gathered in access points areas that we called previously cluster. Each cluster is connected to a network port of the wayside network. The main advantage of this architecture is that a second backbone with the main wayside router MWR has not to be especially adapted for each access point.

If the wayside LAN is made of several subnets between different clusters APCluster1, APCluster2 and the main wayside router MWR, there is an additional local router (cluster router) per subnet mentioned above. All ports of the wayside network are in a single VLAN-area.

Note that we consider the general case when the wayside network backbone is divided into several subnets. Because each access point cluster is connected to the wayside network via a cluster router, the wayside architecture (one or several subnets) and the location of the wayside video server WVS are transparent for the train Client.

The main wayside router MWR addresses the train mobility along the track since it knows at any moment the entire configuration of the wireless network and the configuration of trains associated to access points in its cluster. It forwards the traffic intended to the train to the proper cluster router CR1, CR2 according to the wireless network configuration. The wireless network configuration is the list of the active client for each possible train and the access point it is connected to. So the main wayside router MWR can "reach" any train at any moment.

According a Onboard/wayside-Traffic, the cluster router CR1, CR2 forwards traffic coming from the train to the destination in the client network through the right route map via the main wayside router MWR. According the other Wayside/Onboard-Traffic it forwards the traffic coming from the main wayside router to the train router TR. For that purpose, it creates a "tunnel" inside the WLAN to the train router TR, since it gives the way to reach the train network TN specifying the active client in the train TU as the gateway.

Figure 3:
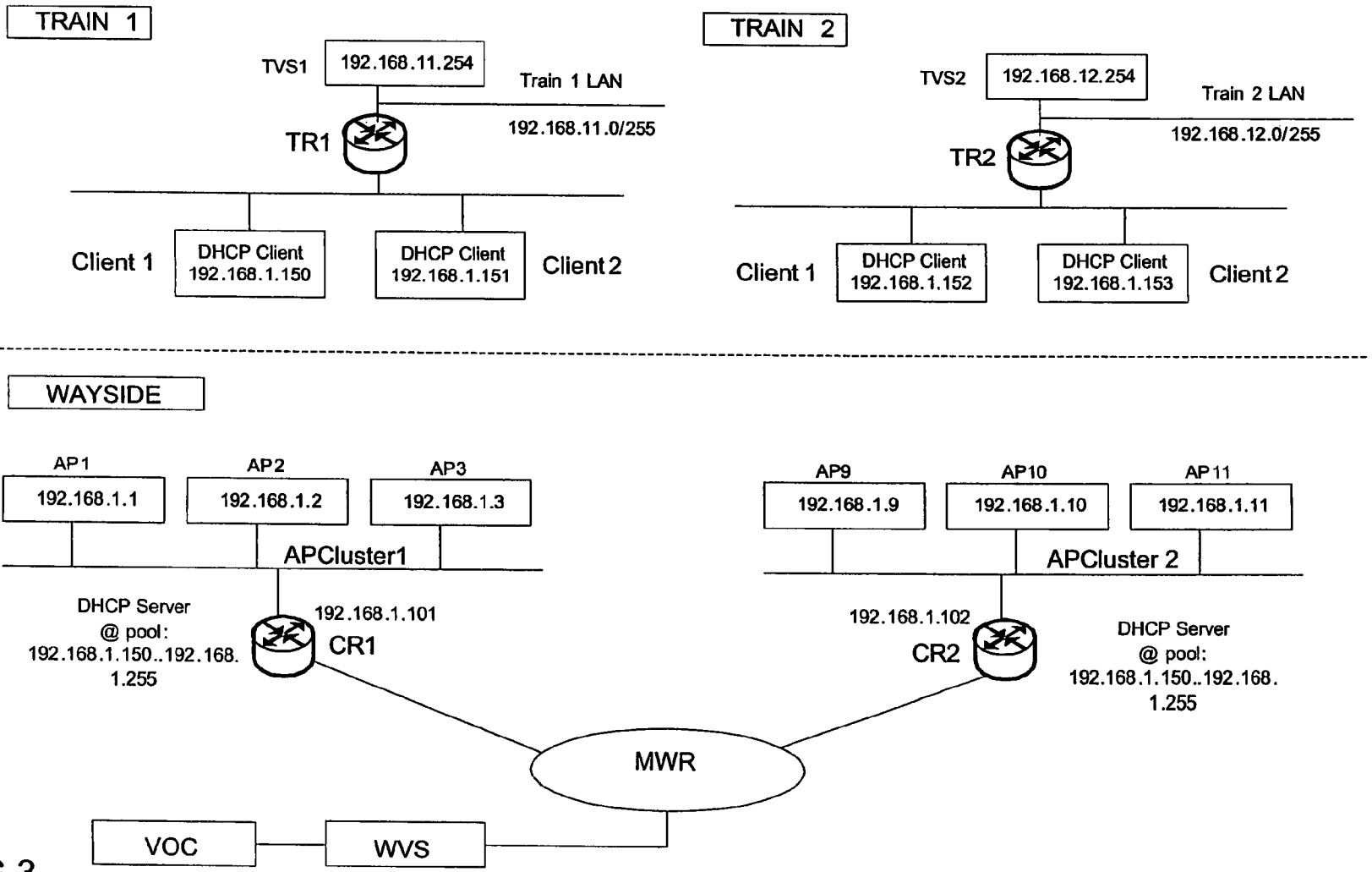
FIG. 3 is a schematic view of the static addressing routing map between two trains and the wayside network.

FIG. 3 is a schematic view of the static addressing map between two trains TRAIN1, TRAIN2 and the wayside network WAYSIDE over the WLAN.

According to FIG. 1, each one of the train TRAIN1, TRAIN2 comprises a train network Train 1 LAN, Train 2 LAN with respectively two clients Client1, Client2, a train router TR1, TR2 and a train video server TVS1, TVS2.

On the wayside, both clusters APCluster1, APCluster2 of FIG. 2 are represented, but each one now with only three access points AP1, AP2, PA3 and AP9, AP10, AP11.

The WLAN train clients Client1, Client2 act as DHCP Clients (DHCP=Dynamic Host Configuration Protocol). Each time a client has to be associated to an access point, it sends a DHCP-request, in order to obtain an IP address (192.168.1.150, 192.168.1.151 for clients of train TRAIN1; 192.168.1.152, 192.168.1.153 for train TRAIN2). Accordingly, DHCP servers implemented in the cluster routers CR1, CR2 at the wayside have a static addressing table @pool (192.168.1.150 to 192.168.1.255 for server of cluster routers CR1, CR2) so that the wireless clients always gets the same address when it roams from one access point to another. This addressing map reduces the roaming time considerably in comparison to a typical client based roaming. Note that if the Wayside Network includes a DHCP Server, the cluster routers can act as DHCP Relay Agent. In this case, they forward the DHCP Request coming from the WLAN clients in the train to the DHCP Server located in the wayside network.

Furthermore both train networks Train 1 LAN, Train 2 LAN are also addressed with corresponding IP addresses 192.168.11.0 to 192.168.11.255 for first train TRAIN1 and 192.168.12.0 to 192.168.12.255 for second train TRAIN2. By this way, each train can be identified at the wayside. Each associated train video server TVS1, TVS2 is also easily addressed with one of the previous addresses (192.168.11.254, 192.168.12.254).

For the access points, an addressing is also possible using the addresses 192.168.1.1 to 192.168.1.3 for the first clustered three access points AP1, AP2, AP3 and the other one 192.168.1.9 to 192.168.1.11 for the second clustered three access points AP9, AP10, AP11. These addresses are still usable, because still not used by each DHCP Server table @pool.

Figure 4:
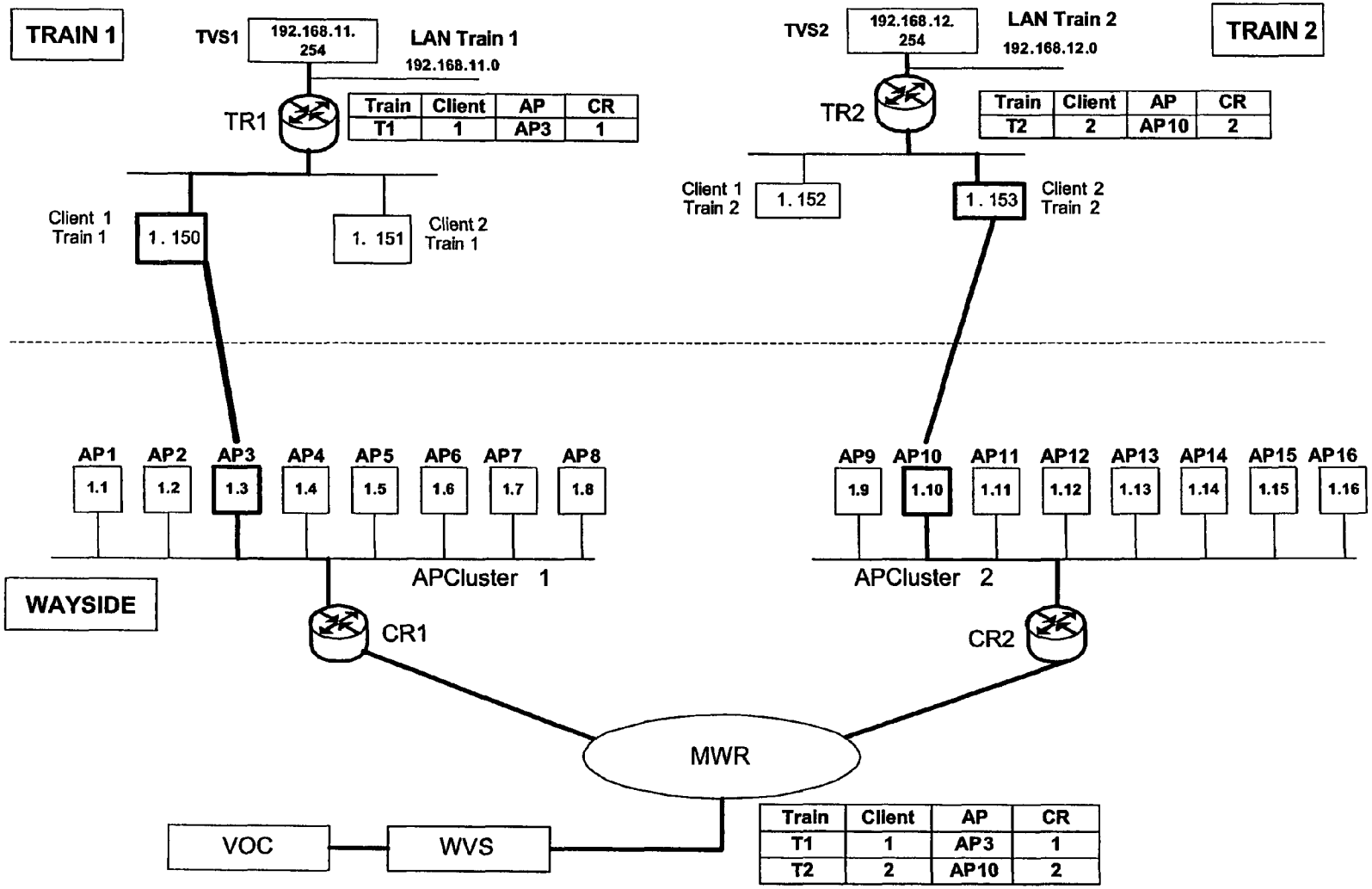
FIG. 4 shows the dynamic routing management between two trains and the wayside network over two selected clients.

FIG. 4 shows the routing management between two different trains and the wayside network over two selected clients according all previous FIGS. 1 to 3. For reason of clarity, only the last address part of the addressing map is shown at the client Client1, Client2 of each train TRAIN1, TRAIN2. Instead of two trains, it could be two coupled train units with optionally a single train router and network.

The selected routing paths are represented with bold lines between both train routers and the wayside network.

According to the invention, the routing management can be described as following:

from the train to the wayside:

A train router TR1, TR2 updates frequently an association table containing this information after measurement of the RSSI at each client i linked to an access point APj:

| Client i | RSSI | APj |
|---|---|---|

Thanks to the RSSI based routing algorithm, it chooses the active client and updates accordingly its routing table. Moreover, it stores a static correspondence table linking the access point APj and the associated cluster router.

| APj | CRk |
|---|---|

The train router TR1, TR2 routes frames to the main wayside server MWR via the active client i and the proper cluster router CRk.

The corresponding table with both routing schemes from first and second train TRAIN1, TRAIN2 are represented in FIG. 4 at the main wayside router MWR (respectively: Train T1, T2; Client 1, 2; access point AP3, AP10; cluster router CR1, CR2)

from the wayside to the train:

When the association routing table in the train changes (change of the active Client, Wireless Client/access point roaming), the train router TR1, TR2 forwards the new association table to the main wayside router MWR so that both router contain routing tables with the same updated content. The train router TR1, TR2 and the wayside routers (cluster routers CR1, CR2 and main wayside router MWR) update frequently this association table. As a result of the RSSI based routing algorithm for determining the highest radio-frequency signal's quality, only one wireless client i (the active one) appears in this table at the wayside in comparison to the routing above. An identifier of the train n or of a train unit can easily be placed in the table, since the identifiable train routers have initiated the tables.

| Train n | Client i | APj |
|---|---|---|

As well, the wayside routers store this static matching table with the access point Apj and the cluster router CRk to use for the routing:

| APj | CRk |
|---|---|

Therefore, at a given moment, the wayside Routers (cluster routers CR1, CR2 and main wayside router MWR) know the complete and the best route to reach each train. The corresponding tables for each train are represented on the top of FIG. 4 (respectively: Train T1, T2; Client 1 or 2; access points AP3, AP10, cluster router CR1, CR2).

In resume, the invention provides a communication system with following main technical features:

- Gateway between Wayside and Trainborne Networks based on WLAN-communication means.
- Diversity of clients involving a WLAN Client at each train end (or more, particularly if a train is made of several units).
- The overall Ethernet routes management is made with three levels of routers:
  1) a Train Router that chooses the best route to the wayside among several WLAN clients and reports to wayside routers every route change.
  2) a Cluster Router associated to each wayside Access Point Cluster where WLAN Access Points are connected.
  3) a Main Wayside Router.

All wayside routers update the routes according to reports from Train Routers, and also poll periodically all Access Points in order to check the Wireless Routers status.

- Roaming between two different Wayside Clusters (or Train Client change involving two different Wayside Subnets) or within a Cluster is performed by the Wayside Main Router.

The invention claimed is:

1. A system for communications between a vehicle network provided on a vehicle and a wayside network, comprising:

a router device in said vehicle network configured to manage routing of data over one of at least two clients of said vehicle network, said two clients being disposed at opposite ends of the vehicle;

a radio-frequency based communication network for providing a connection between each client and an access point of said wayside network; and a monitoring device arranged in said vehicle and configured to control a quality of said connection by configuring the router device to select one of the at least two clients for said data routing between the vehicle and said wayside network;

wherein radio-frequency based connections of both clients are performed over distinctive access points that belong to different clusters which are connected to the wayside network.

2. The communication system according to claim 1, wherein said vehicle is a train with coupled train units, and the router device of a train unit manages data routing over one client among all train units.

3. The communication system according to claim 2, wherein all train units are identical.

4. The communication system according to claim 1, wherein said access points are spatially arranged in a such way that a radio-frequency communication between both clients and the wayside network is permanently enabled over a single or two different clusters.

5. The communication system according to claim 4, wherein the clusters are connected to a main wayside router of the wayside network over a cluster router and wherein a data re-routing from a client linked to a first cluster to a new selected client linked to a second cluster is provided by switching the cluster routers.

6. The communication system according to claim 5, wherein said data re-routing between a new selected client and the main wayside router over different wayside clusters which are linked to different wayside subnets is performed by the main wayside router such that data are switched in real-time to the corresponding selected access point over the cluster router comprising the selected access point.

7. The communication system according to claim 5, wherein the main wayside router includes a routing address of the vehicle over the access point the selected client is associated to and the corresponding cluster router.

8. The communication system according to claim 7, wherein the cluster routers and the access points and their clients belong to a single WLAN-based network even if the wayside network is composed of several subnets.

9. The communication system according to claim 6, wherein the router device manages the data routing using a data table with a first client identifier, a corresponding radio-frequency quality and a second access point identifier linked to the wayside network over an attached cluster router, by change of the data table content said new content is transmitted to the main wayside router over the selected client, then its associated access point and the attached cluster router.

10. The communication system according to claim 9, wherein the data table contains one of a further vehicle identifier and, in case of coupled train units, a train identifier.

11. The communication system according to claim 1, wherein all clients support a broadband data transfer.

12. The communication system according to claim 1, wherein at least one of the clients includes at least one of an acquisition device and a rendering device for real-time data.

* * * * *